US005111235A

United States Patent [19]

Ueno et al.

[11] Patent Number: 5,111,235

[45] Date of Patent: May 5, 1992

[54] METHOD OF OPERATING ELECTROPHOTOGRAPHIC PRINTING APPARATUS

[75] Inventors: Hiroshi Ueno; Yasuo Kikuchi; Kunitomo Takahashi; Koji Doi; Tsukasa Onose; Toshitaka Ogawa, all of Ibaraki, Japan

[73] Assignee: Hitachi Koki Co., Ltd., Tokyo, Japan

[21] Appl. No.: 660,266

[22] Filed: Feb. 26, 1991

Related U.S. Application Data

[63] Continuation-in-part of Ser. No. 399,270, Aug. 28, 1989, abandoned.

[30] Foreign Application Priority Data

Aug. 26, 1988 [JP] Japan ..... 63-212700

[51] Int. Cl.[5] ..... G03G 21/00

[52] U.S. Cl. ..... 355/246; 355/214; 355/219; 430/103

[58] Field of Search ..... 355/208, 245, 246, 261, 355/265, 214, 219; 430/103

[56] References Cited

U.S. PATENT DOCUMENTS

| | | | |
|---|---|---|---|
| 3,788,739 | 1/1974 | Coriale | 355/210 |
| 4,678,317 | 7/1987 | Grossinger | 355/246 X |
| 4,755,850 | 7/1988 | Suzuki et al. | 355/246 X |

FOREIGN PATENT DOCUMENTS

| | | | |
|---|---|---|---|
| 0252569 | 11/1986 | Japan | 355/261 |

*Primary Examiner*—A. T. Grimley
*Assistant Examiner*—J. E. Barlow, Jr.
*Attorney, Agent, or Firm*—Michael L. Keller

[57] ABSTRACT

A method of operating an electrographic printing apparatus which employs a reversal development system with a two components developer wherein the bias voltage and the surface voltage are varied in synchronism with each other.

2 Claims, 5 Drawing Sheets

V
800
600
400
200
0
$V_O$
$V_B$
$V_B$ = 200
$V_B$ = 300
$V_B$ = 400

1000
900
800
700
600
500
400
100
200
300
400
500
SECOND EMBODIMENT
FIRST EMBODIMENT
DRUM SURFACE VOLTAGE $V_O$ (V)
BIAS VOLTAGE $V_B$(V)

FIG. 9

| PROCESS SPEED / PHOTOSENSITIVE BODY | LOW 6.25 INCH/S | MEDIUM 19.375 INCH/S | HIGH 32.5 INCH/S |
|---|---|---|---|
| SeTe | 300 | 338 | 375 |
| SeAs | | | |

METHOD OF OPERATING ELECTROPHOTOGRAPHIC PRINTING APPARATUS

This is a continuation-in-part of application Ser. No. 07/399,270, filed Aug. 28, 1989, abandoned.

BACKGROUND OF THE INVENTION

1. Field of the Invention

The present invention relates to a method of operating an electrophotographic printing apparatus, and particularly to a method of operating an electrophotographic printing apparatus employing a reversal development system with a two-component developer which is generally used for a printer or a copying machine.

2. Description of the Prior Art

FIG. 1 shows the whole configuration of an electrophotographic printing apparatus employing a reversal development system with a two-component developer. In FIG. 1, the electrophotographic printing apparatus is constituted by a photosensitive body 1 and six units disposed around the photosensitive body 1, the six units being a charging unit 2, an exposing unit 3, a developing unit 4, a transferring unit 5, a charge eraser or an erasering unit 6, and a cleaning unit 7.

The photosensitive body 1 is a photoconductive body arranged to rotate at a constant speed. The charging unit 2 is constituted by a high voltage power supply 8 and a charger 9. The charger 9 is supplied with a high voltage from the high voltage power supply 8 so as to generate corona discharge to thereby make the photosensitive body 1 maintain its surface at a fixed potential, that is, a fixed surface potential $V_O$. The exposing unit 3 radiates light onto the charged photosensitive body 1 so as to form an electrostatic latent image on the photosensitive body 1.

The developing unit 4 is constituted by a developer 12 which is a mixture of a toner 10 and a carrier 11, a developing roll 13, a bias voltage supply 14, and a bias voltage variable resistor 15. The toner 10, which is powder ink, is charged by friction with the carrier 11. The developing roll 13, which is a rotating roll, acts to convey the developer 12. The bias voltage supply 14 applies a bias voltage $V_B$ to the developing roll 13. The electrostatic latent image on the photosensitive body 1 is developed by toner 10 in accordance with the potential difference $V_O-V_R$ between the surface potential $V_O$ on the photosensitive body 1 and the residual potential $V_R$ which is a potential on the photosensitive body 1 at the electrostatic latent image portion thereof, and the potential difference $V_B-V_R$ between the bias voltage $V_B$ applied to the developing roll 13 and the residual potential $V_R$. The bias voltage variable resistor 15 varies the bias voltage $V_B$ applied to the developing roll 13 so as to change the quantity of the toner 10 for developing the electrostatic latent image.

The transferring unit 5 acts to transfer the developing toner 10 from the surface of the photosensitive body 1 onto the printing paper 16. The charge eraser 6 lowers the potential of the photosensitive body 1 to the vicinity of zero volt so that the following electrophotographic process can be started. The cleaning unit 7 cleans out the toner 10 which has not been transferred onto the printing paper 16 so as to remain on the surface of the photosensitive body 1.

In a method of changing a printing density with the above conventional printing apparatus, the printing density is so changed by changing the position of the bias voltage variable resistor 15 as to change the potential difference $V_B-V_R$ between the bias voltage $V_B$ of the developing roll 13 and the residual potential $V_R$ at the electrostatic latent image portion on the photosensitive body 1. In FIG. 2 is shown the relationship between the printing density and the potential difference $V_B-V_R$ between the bias voltage $V_B$ and the residual potential $V_R$.

However, problems in printing quality on the printing paper, for example, such as line width, field stains (so-called bronzing), and carrier stick (poor transfer due to sticking of the carrier 11 on the surface of the photosensitive body 1), are relative to the potential difference $V_O-V_B$ between the surface potential $V_O$ of the photosensitive body 1 and the bias voltage $V_B$ of the developing roll 13. There is shown in FIG. 3 the relationship among the potential difference $V_B-V_R$ between the bias voltage $V_B$ and the residual potential $V_R$, the potential difference $V_O-V_B$ between the surface potential $V_O$ and the bias voltage $V_B$, the printing density, the line width, the field stains, the carrier stick. Since the line width and field stains are opposite in factor to the carrier stick, there has been a drawback that it is impossible to set the variable range of the printing density wide enough.

SUMMARY OF THE INVENTION

The present invention has been attained as the result of the investigation on improvement of the printing quality in an electrophotographic printing apparatus employing the reversal development system with a two-component developer.

It is an object of the present invention to provide an improved operating method of an electrophotographic printing apparatus, in which printing quality is superior to the prior art in view of any point of the conditions opposed to each other such as line width, field stains, and carrier stick so that the line width can be made proper, the field stains can be made little, and the carrier stick can be made little, even if the variable range of printing density on printing paper is expanded.

In order to attain the above object, according to the present invention, the operation method of an electrophotographic printing apparatus comprises the steps of charging a photosensitive body by using a charging unit, exposing a charged surface of said photosensitive body by using an exposing unit so as to form an electrostatic latent image on said surface of said photosensitive body, and developing said electrostatic latent image on said photosensitive body through a bias development system by using a developing unit, in which a surface potential ($V_O$) of said photosensitive body is changed in synchronism with a bias voltage ($V_B$) applied to a developing roll of said developing unit.

That is, according to the present invention, as described above, the bias voltage and the surface potential are changed in synchronism with each other, on the basis of the fact that the problems in printing quality of printing paper, such as line width, field stains, and carrier stick, relate to the potential difference between the surface potential of the photosensitive body and the bias voltage of the developing roll, and that if the potential difference between the surface potential and the bias voltage of the developing roll is constant, the problems in printing quality such as line width, field stains, and carrier stick are solved even if the potential difference between the bias voltage and the residual voltage on the photosensitive body at an electrostatic latent image portion thereof is much changed.

BRIEF DESCRIPTION OF THE DRAWINGS

FIG. 9 is a table showing the values of B as the process speed is changed.

DETAILED DESCRIPTION OF PREFERRED EMBODIMENT

Figure 4:
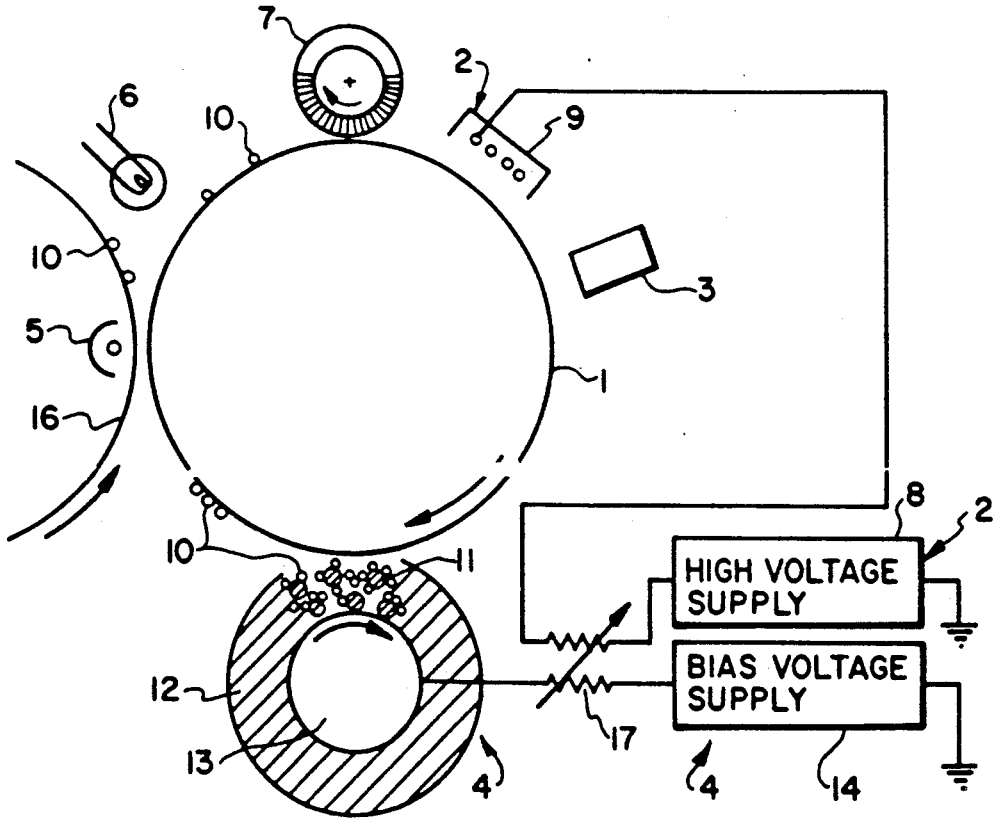
FIG. 4 is a schematic explanatory view illustrating the whole configuration of a specific example of the electrophotographic printing apparatus in which the method according to the present invention is realized.

Referring to FIG. 4, an embodiment of the present invention will be described hereunder. In FIG. 4, items the same as or equivalent to those in FIG. 1 are correspondingly reference, that is, there are provided a photosensitive body 1, a charging unit 2, an exposing unit 3, a developing unit 4, a transferring unit 5, a charge eraser 6, a cleaning unit 7, a high voltage supply 8 of the charging unit 2, a charger 9, a developer 12 composed of toner 10 and carrier 11, a developing roll 13, a bias voltage supply 14, and printing paper 16.

Figure 1:
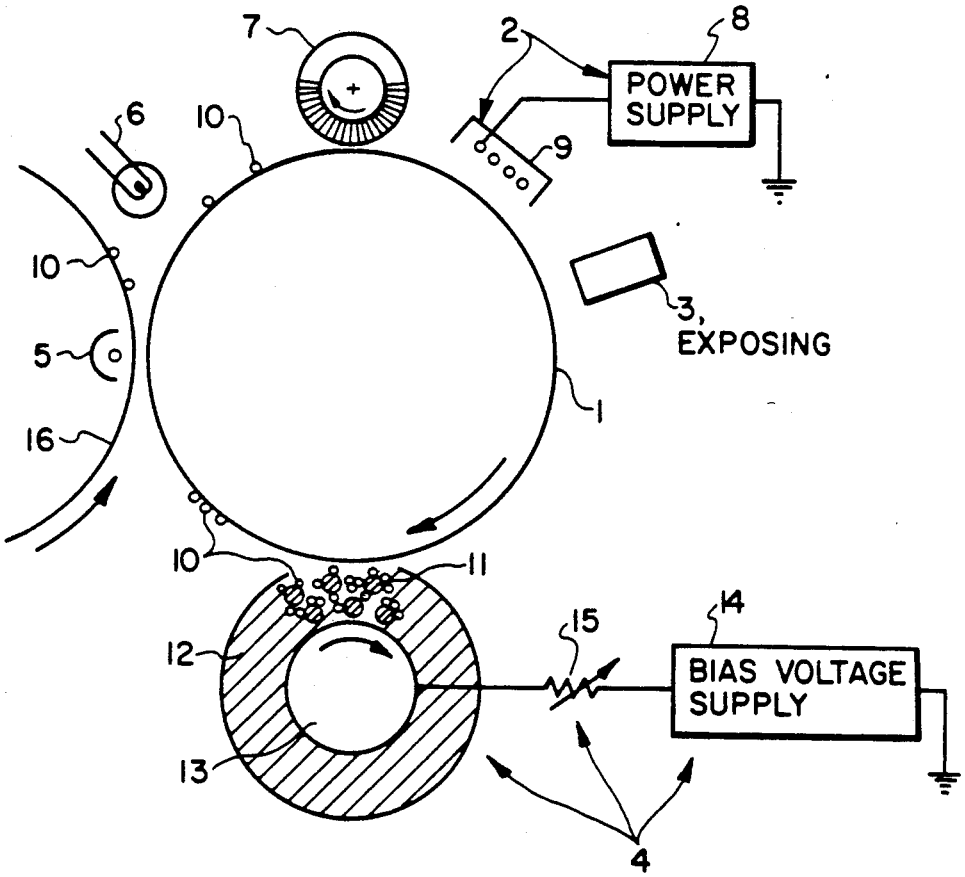
FIG. 1 (PRIOR ART)
FIG. 1 is a schematic explanatory view illustrating the whole configuration of the conventional electrophotographic printing apparatus.
Figure 2:
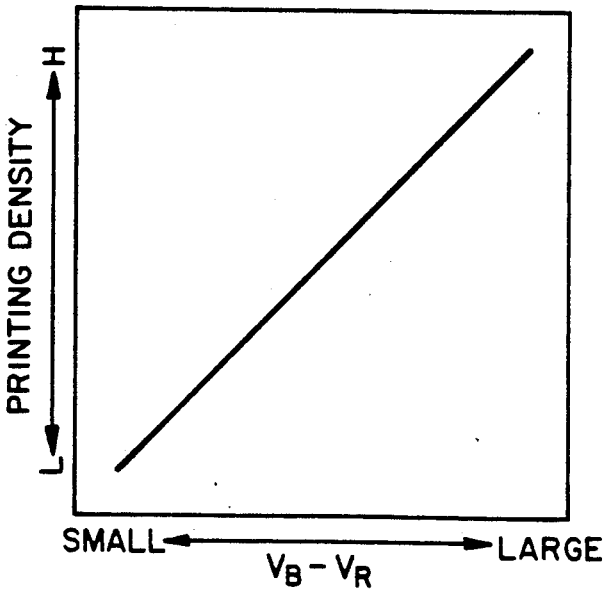
FIG. 2 is a characteristic diagram showing the relation between the printing density and the potential difference $V_B$–$V_R$ between the bias voltage applied to the developing roll and the residual voltage $V_R$ on the photosensitive body at an electrostatic latent image portion thereof.
Figure 3:
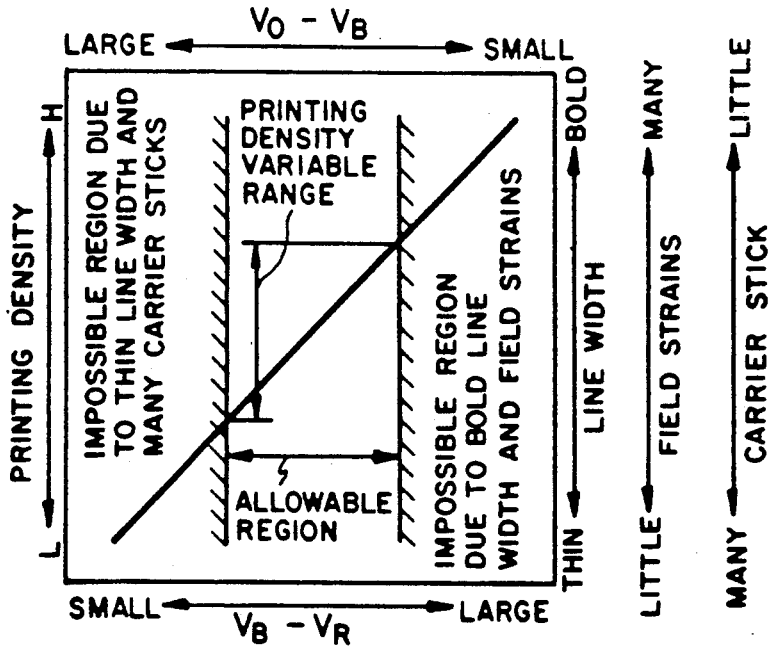
FIG. 3 is a characteristic diagram showing the relation among the potential difference $V_B$–$V_R$ between the bias voltage $V_B$ of the developing roll and the residual voltage $V_R$ on the photosensitive body at an electrostatic latent image portion thereof, the potential difference $V_O$–$V_B$ between the surface voltage $V_O$ on the photosensitive body and the bias voltage $V_B$, the printing density, the line width, the field stains, and the carrier stick.

In FIG. 4, a bias-voltage-surface-potential synchronization variable resistor 17 is used in place of the bias voltage variable resistor 15 of the conventional developing unit 4 shown in FIG. 1 so that the relation between the surface potential $V_O$ of the photosensitive body 1 and the bias voltage $V_B$ of the developing roll 13 is selected so as to be $V_O = a \times V_B + b$ (a=1, b is variable depending on the kinds of the photosensitive body 1, the developing unit 4, the toner 10, and the carrier 11).

The following examples are given to aid one of ordinary skill in this art in selecting the appropriate values of a and b.

FIRST EXAMPLE:

In the following first example, there was used an electrophotographic printing apparatus having an Se-Te based Selenium photosensitive body (positive electric charging photosensitive body) which rotates at 32.5 inch/sec as a printing process speed. The parameters of the expression (1) are set as follows:

$$V_O = aV_B + b \quad (1)$$

$$V_O = V_B - 300 \quad (2)$$

$$(a = 1,\ b = 300)$$

In the case where the charging characteristics of a charging unit are lowered, that is, power voltage is lowered, an electric charge gap exceeds a setting value, or an electric wire becomes dirty, the value of a must be made large in order to compensate the lowering of the power voltage. However, in general, a is set to approximately 1. On the other hand, b is set to 300 V.

Figure 6:
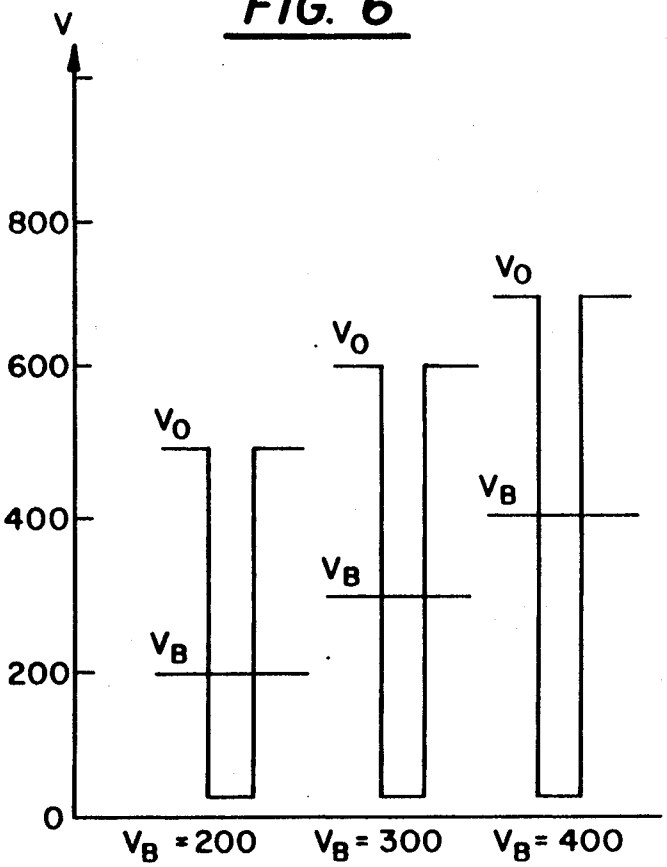
FIGS. 5 and 6 are graphs showing the relationship between $V_O$ and $V_B$ as $V_B$ is adjusted between 200 V and 400 V.
Figure 5:
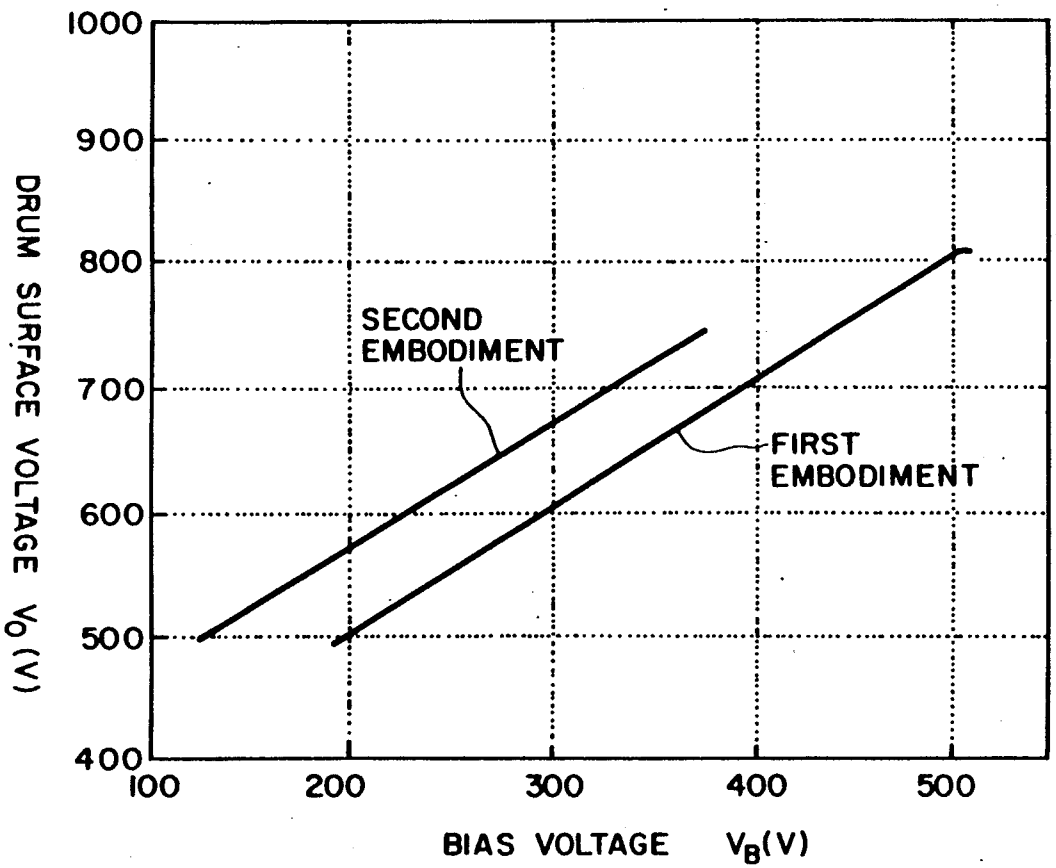

Under this condition, as shown in FIGS. 5 and 6, $V_B$ is adjusted between 200 V and 400 V while $V_O$ is changed in synchronism with $V_B$. As a result, it is possible to set the adjustable range of the printing density wide enough without any fog and carrier stick.

SECOND EXAMPLE:

In the following second example, there was used an electrophotographic printing apparatus providing an Se-Te based Selenium photosensitive body (positive electric charging photosensitive body) which rotates at 6.25 inch/sec as a printing process speed. The parameters of the expression (1) above is set as follows:

$$V_O = V_B + 375 \quad (3)$$

$$(a = 1,\ B = 375) \quad (3)$$

Figure 7:
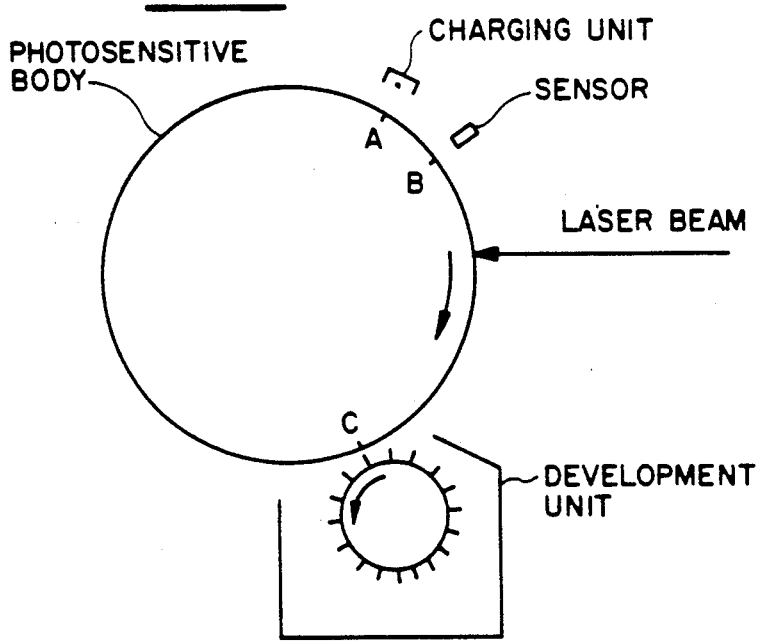
FIG. 7 is a schematic view of Example 1.
Figure 8:
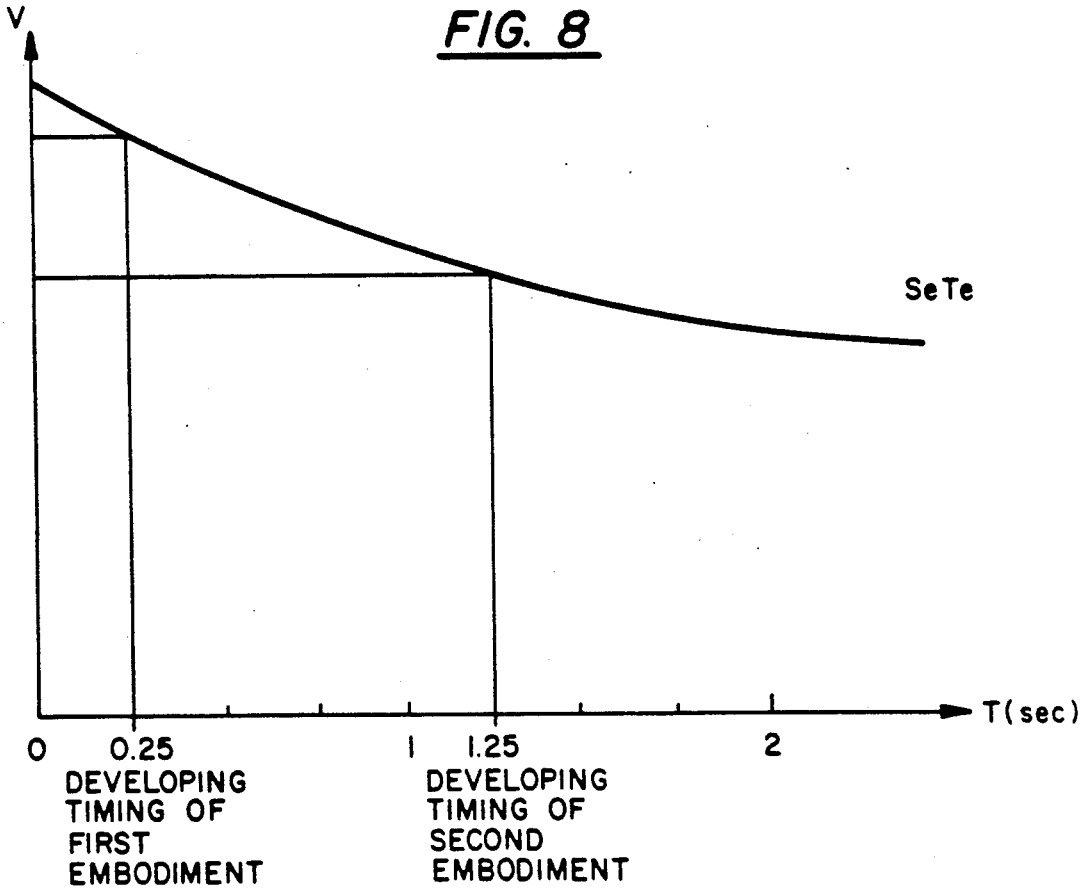
FIG. 8 is a graphic representation of FIG. 7.

That is, as shown in FIG. 7, while the photosensitive body moves from a charging point A to a developing point B, the surface potential of the photosensitive body is attenuated under the dark condition due to leakage current flowing to the base of the photosensitive body as shown in FIG. 8 which is a graph showing a dark attenuation ratio of the surface potential of the photosensitive body. The surface potential of the apparatus having a slower printing process speed (as in the first example) is remarkably reduced in comparison with that which has a higher printing process speed (as in the second example). Accordingly, it is necessary to set the surface potential high in advance.

According to the present invention, the toner density is adjustable within a wide range without occurrence of fog and carrier stick. The factors which affect the printing density include not only the surface potential of the photosensitive body and the bias voltage, but also circumstance conditions such as a temperature, a humidity, etc. and the characteristics of toner, carrier, sheets, developing unit, and so on. However, in the present invention, the relationship between the surface potential of the photosensitive body and the bias voltage is improved provided that the other factors are constant. Table 1 in FIG. 9 shows the values of the parameter b when the process speed is changed.

Thus, as described above, the problems in printing quality of printing paper 16, such as line width, field stains, and carrier stick, relate to the potential difference $V_O - V_B$ between the surface potential $V_O$ of the photosensitive body 1 and the bias voltage $V_B$ of the developing roll 13, and if the potential difference $V_O - V_B$ between the surface potential $V_O - V_B$ and the bias voltage $V_B$ of the developing roll 13 is constant, the problems in printing quality such as line width, field stains, and carrier stick are solved even if the potential difference $V_B - V_R$ between the bias voltage $V_B$ and the residual voltage $V_R$ on the photosensitive body at an electrostatic latent image portion thereof is much changed.

According to the present invention, in the electrophotographic printing apparatus employing a reversal development system with a two-component developer, the bias voltage $V_B$ and the surface voltage $V_O$ are varied in synchronism with each other, so that the printing quality is superior to the prior art in view of any point of the conditions opposed to each other such as line width, field stains, and carrier stick so that the line width can be made proper, the field stains can be made little, and the carrier stick can be made little, even if the variable range of printing density on printing paper 16 is expanded.

It should be noted that the present invention is made on the premise that the residual voltage $V_R$ is substantially constant.

What is claimed is:

1. A method of operating an electrophotographic printing apparatus, comprising the steps of:

charging a photosensitive body by using a charging unit;

exposing a charged surface of said photosensitive body by using an exposing unit so as to form an electrostatic latent image on said surface of said photosensitive body; and developing said electrostatic latent image on said photosensitive body through a bias development system by using a developing unit, in which the relationship of a bias voltage $V_B$ applied to a developing roll of said developing unit and a surface potential $V_O$ of said photosensitive body satisfies the following conditions: $V_O = a.V_B + b$; $0 < a$; and $0 < b < V_O$.

2. A method of operating an electrophotographic printing apparatus according to claim 1, in which a circuit for changing said bias voltage $V_B$ applied to said developing roll in synchronism with said surface potential $V_O$ of said photosensitive body is operated by bias-voltage-surface-potential synchronization adjusting means of said developing unit.

* * * * *